United States Patent [19]

Burleson

[11] Patent Number: 4,686,909

[45] Date of Patent: Aug. 18, 1987

[54] RAIL CAR BRIDGE PLATE SECUREMENT ASSEMBLY WITH ROTATING LEAF

[75] Inventor: Robert M. Burleson, Adamsville, Pa.

[73] Assignee: Greenville Steel Car Company, Greenville, Pa.

[21] Appl. No.: 783,941

[22] Filed: Oct. 3, 1985

[51] Int. Cl.[4] ..... B61D 3/18; B60J 5/10; E05B 65/14

[52] U.S. Cl. ..... 105/378; 160/201; 49/411

[58] Field of Search ..... 410/26, 27; 105/436, 105/378, 458, 410, 459; 414/537; 14/2.4, 69.5, 71.1; 296/55, 155; 160/196 R, 196 D, 199, 201; 49/411

[56] References Cited

U.S. PATENT DOCUMENTS

| | | | |
|---|---|---|---|
| 3,195,478 | 7/1965 | Thompson | 105/458 |
| 3,572,254 | 3/1971 | Slager | 105/458 |
| 4,274,172 | 6/1981 | Franklin | 14/69.5 |
| 4,437,410 | 3/1984 | Stoller, Sr. et al. | 105/378 |

*Primary Examiner*—Robert B. Reeves
*Assistant Examiner*—Scott H. Werny
*Attorney, Agent, or Firm*—Webb, Burden, Robinson & Webb

[57] ABSTRACT

An assembly for securing a standard bridge plate to the upper deck of a railroad car arranged to carry automobiles on at least two levels, said railroad cars having a track member from which a sliding door is hung positioned adjacent the edge of the deck at the end of the railroad car comprises a fixed leaf secured to the surface of the deck and spaced gudgeons mounted to an end of said fixed leaf. A rotating leaf has spaced gudgeons mounted thereto for being positioned between the spaced gudgeons secured to the fixed leaf. Pins pass through the gudgeons and secure the leaves together such that the rotating leaf may be turned back onto the surface of the deck or may be rotated to bridge the track member from which the door is hung. The rotating leaf has an offset therein so that a portion of said rotating leaf extending away from the deck and beyond the track member is positioned downwardly of the top of said track member. Spaced gudgeons are mounted to the face of the portion of the rotating leaf extending away from the deck and are arranged for receipt of a pin for securing the standard bridge plate.

15 Claims, 6 Drawing Figures

RAIL CAR BRIDGE PLATE SECUREMENT ASSEMBLY WITH ROTATING LEAF

BACKGROUND OF THE INVENTION

Railroad cars that are adapted to carry automobiles are enclosed structure. Such railroad cars are provided with sidewalls, a roof spanning the sidewalls and ends that are closed off by doors. Typically, the railroad cars are designed to have a floor and either one or two intermediate decks supported above the floor for holding automobiles loaded thereon. The automobiles are driven from platforms at the end of the railroad car onto either the floor or one of the decks of the railroad car during loading.

The height of the railroad car is a critical matter. Due to limitations (underpasses, tunnels, and the like) along the railway, the height of the car is restricted, especially, in the case of a car designed for three levels, i.e. having two decks supported above the floor. The total height of each automobile is thus limited by the height of the roof above the floor and by the width of the decks. A saving of two or three inches can be of great significance.

A number of end closure (door) designs are known for the railroad cars of the type being discussed. Usually, the doors slide from the closed position to a position along the inside of the sidewalls of the railroad car. Referring to FIG. 1, the doors are hung from a tubular track member 10, for example a hollow tube having a long axial slot extending substantially the length thereof. The tracking elements, for example, rollers 11 are arranged to roll within the tubular track member. A pendent bracket 12 extends downwardly from its pivotal connection with the rollers 11. The bracket passes through the slot in the bottom of the tube. The sliding doors 13 are secured to the bracket 12.

The tubular track member 10 is mounted at the same level above the floor (not shown) as a deck 15 supported above the floor for carrying automobiles. The track member 10 may be held to the deck 15 by cantilevered brackets 16 that extend over the top of the track member 10 leaving the slot in the bottom thereof unobstructed. The cantilevered bracket is welded directly to the top of the track member 10 and to the top of the deck 15.

It is current practice to drive the automobiles onto the railroad cars from stationary platforms positioned at the ends thereof. To support the automobiles as they pass from the stationary platform to the deck of the railroad car, a standard bridge plate 18 is emplaced (see FIG. 2). The standard bridge plate is a plate having a gudgeon 19 (usually a 2 inch pipe section about 17½ inches long) welded to the bottom surface of the bridge plate. Fixed to the top surface of the deck (or the rail) are two spaced gudgeons 20 (usually 2 inch pipe sections 2 inches long spaced about 18 inches apart). Thus, when the gudgeon 19 on the bridge plate is axially aligned with the gudgeons 20 on the deck, a rod 21 may be passed therethrough for fastening the bridge plate 18 to the deck 15. The other end of the bridge plate rests upon a stationary platform (not shown). Since the bridge plate just described supports the wheels on one side of an automobile only, two bridge plates are required for each deck. The bridge plates must be spaced apart the width of the wheels of an automobile.

The thickness of the 2 inch pipe and bridge plate raised above the deck (T in FIG. 2) diminishes the deck-to-roof distance and thus the height of the automobiles that can be carried upon the deck.

It is an advantage according to this invention to provide an assembly for securing a standard bridge plate to the upper deck of a railroad car arranged for carrying automobiles without reducing the deck-to-roof dimension.

SUMMARY OF THE INVENTION

Briefly, according to this invention, there is provided an assembly for securing a bridge plate to the upper deck of a railroad car arranged to carry automobiles on at least two levels. The railroad car has a track member from which a sliding door is hung positioned adjacent the edge of a deck at one or both ends of the railroad car. The improvement, according to this invention, comprises a hinged-like assembly including a fixed leaf secured to the deck, spaced gudgeons mounted to said leaf at the end thereof, a rotating leaf having spaced gudgeons mounted thereto for being positioned between the spaced gudgeons secured to the fixed leaf, pins for passing through the gudgeons and to secure the leaves together such that the rotating leaf may be turned back onto the deck or may be rotated to bridge the track member from which the door is hung. The rotating leaf has an offset thereon so that the offset portion of the rotating leaf extends away from the deck, beyond the track member and positioned downward of the top of the track member. Spaced gudgeons are mounted to the face of the portion of the rotating leaf extending away from the deck and are arranged for receipt of a pin for securing a standard bridge plate assembly.

THE DRAWINGS

Further features and other objects and advantages of this invention will become clear from the following detailed discussion made with reference to the drawings in which FIG. 1 is a side view of the edge of a deck shown in section, the track for supporting a sliding door shown in section and the door itself in the closed position for a typical prior art railroad car arranged for carrying automobiles;

DESCRIPTION OF THE PREFERRED EMBODIMENTS

Figure 4:
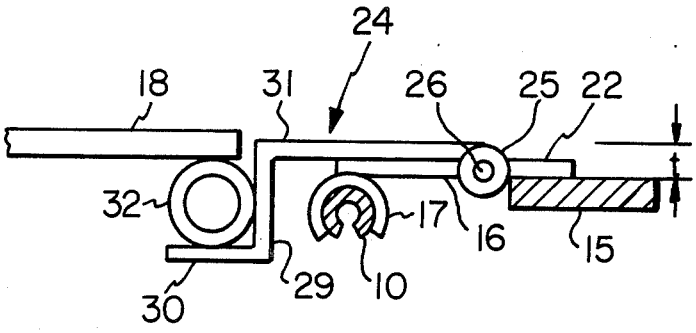
FIG. 4 is a side view according to this invention with the sliding door moved out of view and the bridge plate emplaced.
Figure 5:
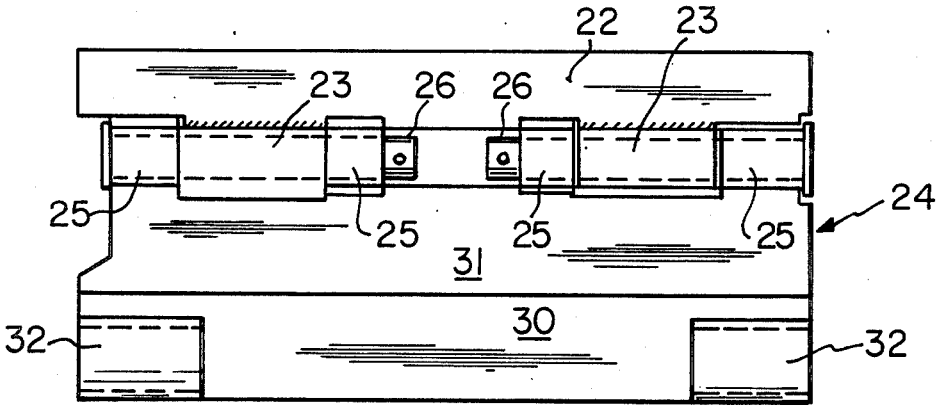
FIG. 5 is a plan view of a hinge-like apparatus according to this invention.
Figure 3:
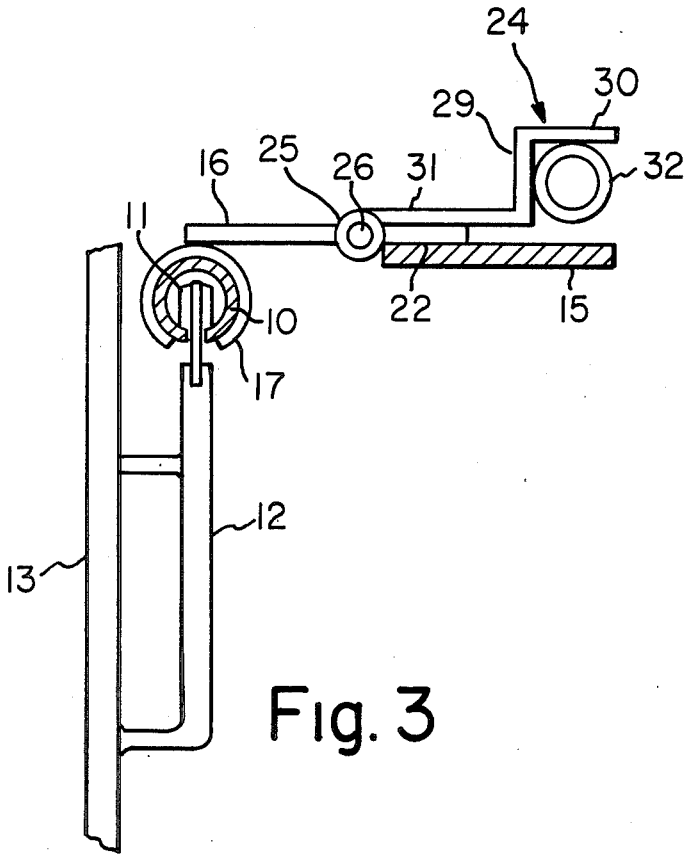
FIG. 3 is a side view according to this invention with the sliding door drawn to the closed position.
Figure 6:
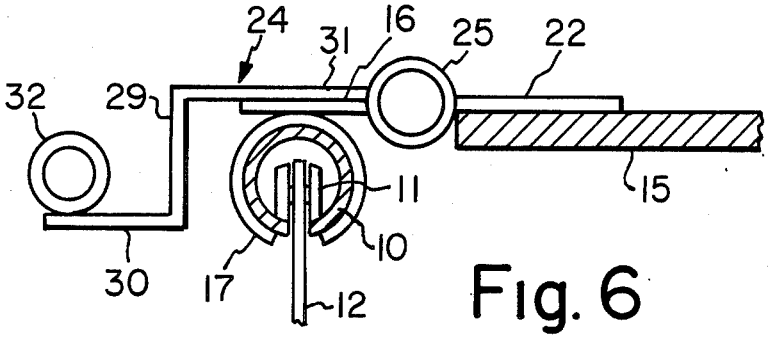
FIG. 6 is a side view of a hinge-like apparatus according to this invention.

Referring now to FIGS. 3 and 4, there is illustrated an assembly according to this invention. A track member 10 is mounted, spaced outwardly from the edge of the deck 15. The track is held by cantilevered brackets 16 and clamp 17. In FIGS. 3 and 4, the portion of the bracket 16 that abuts the surface of the deck and is welded thereto is hidden behind the assembly to be described. The sliding door 13 is suspended from the track member 10 by rollers 11 and pendent bracket 12.

Referring now to FIGS. 3, 4, 5 and 6, the unique assembly according to this invention comprises a hinge-like structure having a fixed leaf 22 welded to the deck 15. Welded to the distal end of the fixed leaf 22 are spaced gudgeons 23 (see FIG. 5) comprised, for example, of short lengths of 3/4 inch pipe. The rotating leaf 24 also has spaced gudgeons 25 welded thereto. Pins 26 pass through the aligned gudgeons 23, 25 to hold the assembly together.

The rotating leaf 24 is provided with an offset by two preferably equal, but opposite, bends (preferably right angle bends) such that a lateral section 29, extending section 30 and reaching section 31 of the rotating leaf 24 are defined. The surface plane of the extending section 30 is preferably parallel to the surface plane of the reaching section 31 to which the spaced gudgeons 25 are welded. The reaching section 31 is sufficiently wide (from edge adjacent gudgeons to the lateral section 29) to span the track member 10, when rotated into the loading position (as shown in FIG. 4).

Mounted to the face of the extending section 30 are spaced gudgeons 32 (for example sections of 1 inch pipe) which cooperate with a standard bridge plate 18 (shown in FIG. 4) and are arranged for receipt of a pin for securing the bridge plate. The lateral section 29 is sufficiently deep (fold to fold) so that the extending section 30 is laterally spaced from the reaching section 31 a distance substantially equal to the entire outer diameter of the gudgeons 32. This way the bridge plate rises only slightly over the height of the track member 10 and does not diminish the distance between the deck and the roof.

Figure 1:
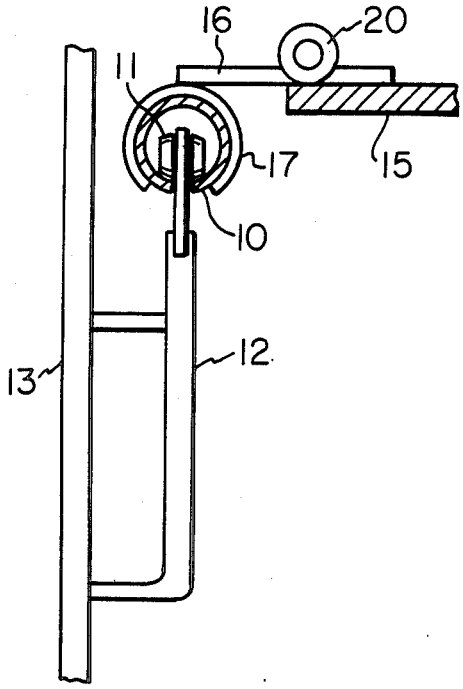
Fig. 1 PRIOR ART
Figure 2:
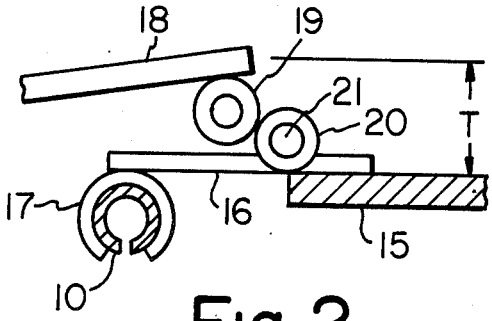
Fig. 2 PRIOR ART
FIG. 2 is a side view in section similar to FIG. 1 with the door pushed out of view and the bridge plate emplaced for loading and unloading the automobiles.

Now compare FIGS. 2 and 4, it should be apparent that with the prior art arrangement (FIG. 2), the bridge plate is placed such that the distance between the deck and roof is diminished by the distance T, which may be between 2 and 3 inches. With the arrangement according to this invention (see FIG. 4) with the bridge plate in place, the distance between the surface of the deck and the roof is only diminished the distance t which is approximately $\frac{3}{8}$ inch. Moreover, the $\frac{3}{8}$ inch is occupied by the thickness of the cantilevered bracket 16 which cannot be eliminated. After the automobiles are loaded, the rotating portion 24 of the hinge-like arrangement is swung onto the surface of the deck thus clearing the track member 10 and enabling the door 13 to be slid into the closed position.

Having thus described the invention with the detail and particularly required by the Patent Laws, what is desired protected by Letters Patent is set forth in the following claims.

I claim:

1. An assembly for securing a standard bridge plate to an upper deck of a railroad car arranged to carry automobiles on at least two levels, said railroad cars having a track member, from which a sliding door is hung, said track member mounted to the underside of a distal end of brackets attached to an edge of the deck at the end of the railroad car, the improvement comprising:

a fixed leaf secured to the surface of the deck extending therefrom to a distal end intermediate said track member and said deck edge and having spaced gudgeons mounted to said distal end of said fixed leaf;

a rotating leaf having spaced gudgeons mounted thereto for being positioned between the spaced gudgeons secured to the fixed leaf;

pins for passing through the gudgeons and securing the leaves together such that the rotating leaf may be turned back onto the surface of the deck or may be rotated to bridge the track member from which the door is hung;

said rotating leaf having an offset thereon so that a portion of said rotating leaf extending away from the deck and beyond the track member is positioned downwardly of the top of said track member; and spaced gudgeons mounted to a face of the portion of the rotating leaf positioned below and extending away from the deck and arranged for receipt of a pin for securing the standard bridge plate.

2. An assembly for securing a standard bridge plate to an upper deck of a railroad car arranged to carry automobiles on at least two levels, said railroad cars having a track member, from which a sliding door is hung, said track member mounted to the underside of a distal end of brackets attached to an edge of the deck at the end of the railroad car, the improvement comprising:

a fixed leaf secured to the surface of the deck extending therefrom to a distal end intermediate said track member and said deck edge and having spaced gudgeons mounted to said leaf at said distal end thereof;

a rotating leaf comprised of a reaching section having spaced gudgeons mounted thereon for positioning between the spaced gudgeons secured to the fixed leaf, an extending section extending away from the deck, beyond the track member, positioned downwardly of the top of said track member, and further having spaced gudgeons mounted to a face of the extending section, said gudgeons arranged for receipt of a pin for securing the standard bridge plate; and pins for passing through the gudgeons and securing the fixed leaf and rotating leaf together such that the rotating leaf may be pinoted back onto the surface of the deck or may be rotated to bridge the track member from which the door is hung.

3. An assembly for securing a standard bridge plate to the upper deck of a railroad car arranged to carry automobiles on at least two levels, said railroad cars having a track member from which a sliding door is hung positioned adjacent the edge of the deck at the end of the railroad car, the improvement comprising:

a fixed leaf secured to the surface of the deck and having spaced gudgeons mounted to an end of said fixed leaf;

a rotating leaf having spaced gudgeons mounted thereto for being positioned between the spaced gudgeons secured to the fixed leaf;

pins for passing through the gudgeons and securing the leaves together such that the rotating leaf may be turned back onto the surface of the deck or may be rotated to bridge the track member from which the door is hung;

said rotating leaf having an offset therein so that a portion of said rotating leaf extending away from the deck and beyond the track member is positioned downwardly of the top of said track member, wherein the offset of said rotating leaf includes two opposite bends to define a lateral section, a reaching section and an extending section, with said extending section being the portion of the rotating leaf which extends away from the deck; and spaced gudgeons mounted to the face of the portion of the rotating leaf extending away from the deck and arranged for receipt of a pin for securing the standard bridge plate.

4. An assembly as claimed in claim 3 wherein the two opposite bends of the offset are at equal angles of about 90° so that a surface plane of the extending section is parallel to a surface plane of the reaching section of the rotating leaf.

5. An assembly as claimed in claim 3 wherein the reaching section is sufficiently wide to span the track member when rotated to bridge said track member.

6. An assembly as claimed in claim 3 wherein the lateral section is sufficiently wide so that the extending section is laterally spaced from the reaching section a distance substantially equal to the outer diameter of the spaced gudgeons mounted to the face of the extending section.

7. An assembly as claimed in claim 6 wherein the spaced gudgeons mounted to the face of the extending section are comprised of short lengths of pipe having an outer diameter of about 1 inch.

8. An assembly as claimed in claim 3 wherein the spaced gudgeons mounted to said fixed leaf are comprised of short lengths of pipe having an outer diameter of about $\frac{3}{4}$ inch.

9. An assembly for securing a standard bridge plate to the upper deck of a railroad car arranged to carry automobiles on at least two levels, said railroad cars having a track member from which a sliding door is hung positioned adjacent the edge of the deck at the end of the railroad car, the improvement comprising:

a fixed leaf secured to the surface of the deck and having spaced gudgeons mounted to said leaf at the end thereof;

a rotating leaf comprised of a reaching section and extending section and having spaced gudgeons mounted to said reaching section for positioning between the spaced gudgeons secured to the fixed leaf and further having spaced gudgeons mounted to the face of the extending section, wherein the extending portion and the reaching portion of the rotating leaf are separated by two opposite bends to define a lateral section, with said gudgeons arranged for receipt of a pin for securing the standard bridge plate; and pins for passing through the gudgeons and securing the fixed leaf and rotating leaf together such that the rotating leaf may be turned back onto the surface of the deck or may be rotated to bridge the track member from which the door is hung.

10. An assembly as claimed in claim 9 wherein said extending section of said rotating leaf that extends away from the deck and beyond the track member is positioned downwardly of the top of said track member.

11. An assembly as claimed in claim 9 wherein the opposite bends are at equal angles of about 90° so that a surface plane of the extending section is parallel to a surface plane of the reaching section of the rotating leaf.

12. An assembly as claimed in claim 9 wherein the lateral section is sufficiently wide so that the extending section is laterally spaced from the reaching section a distance substantially equal to an outer diameter of the spaced gudgeons mounted to the face of the extending section.

13. An assembly as claimed in claim 9 wherein the reaching section is sufficiently wide to span the track member when rotated to bridge said track member.

14. An assembly as claimed in claim 9 wherein the spaced gudgeons mounted to the face of the extending section are comprised of short lengths of pipe having an outer diameter of about 1 inch.

15. An assembly as claimed in claim 9 wherein the spaced gudgeons mounted to said fixed leaf are comprised of short lengths of pipe having an outer diameter of about $\frac{3}{4}$ inch.

* * * * *

UNITED STATES PATENT AND TRADEMARK OFFICE

CERTIFICATE OF CORRECTION

PATENT NO. : 4,686,909

DATED : August 18, 1987

INVENTOR(S) : Robert M. Burleson

It is certified that error appears in the above-identified patent and that said Letters Patent is hereby corrected as shown below:

Column 1 Line 7 "structure" should read —structures—.

Column 3 Line 53 "particularly" should read —particularity—.

Claim 1 - Column 4 Line 9 "thereon" should read —therein—.

Claim 2 - Column 4 Line 42 "pinoted" should read —pivoted—.

Signed and Sealed this

First Day of March, 1988

*Attest:*

*Attesting Officer*

DONALD J. QUIGG

*Commissioner of Patents and Trademarks*